US007213292B1

(12) United States Patent
Tucker

(10) Patent No.: US 7,213,292 B1
(45) Date of Patent: May 8, 2007

(54) BENDABLE SHAFT BODY TOILETRY APPARATUS

(76) Inventor: Stuart L. Tucker, 8624 Tourmaline Blvd., Boynton Beach, FL (US) 33427

( * ) Notice: Subject to any disclaimer, the term of this patent is extended or adjusted under 35 U.S.C. 154(b) by 442 days.

(21) Appl. No.: 10/844,477

(22) Filed: May 13, 2004

(51) Int. Cl.
*B25G 1/06* (2006.01)

(52) U.S. Cl. ..... 15/144.1; 15/144.2; 16/422; 16/436; 16/900; 294/19.1; 294/24

(58) Field of Classification Search ..... 15/143.1, 15/144.1, 144.2, 146, 172; 16/110.1, 422, 16/436, 900; 294/19.1, 24
See application file for complete search history.

(56) References Cited

U.S. PATENT DOCUMENTS

| | | | | | |
|---|---|---|---|---|---|
| 500,467 | A * | 6/1893 | Bliss | ..... | 15/104.066 |
| 750,357 | A | 1/1904 | Gibbons | | |
| 1,154,369 | A | 9/1915 | Browning | | |
| 3,590,414 | A * | 7/1971 | Gores | ..... | 15/4 |
| 4,819,293 | A * | 4/1989 | Nicholson | ..... | 15/172 |
| 5,315,732 | A * | 5/1994 | Huefner et al. | ..... | 15/167.1 |
| 5,671,497 | A | 9/1997 | Abdo | | |
| 5,823,592 | A * | 10/1998 | Kalidindi | ..... | 294/24 |
| 5,960,509 | A | 10/1999 | Wu | | |
| 6,154,913 | A | 12/2000 | Burton | | |
| 6,161,244 | A * | 12/2000 | Jeannet et al. | ..... | 15/167.1 |
| 6,546,588 | B1 | 4/2003 | Black | | |
| 6,990,706 | B2 * | 1/2006 | Broecker et al. | ..... | 15/167.1 |

* cited by examiner

*Primary Examiner*—Mark Spisich
(74) *Attorney, Agent, or Firm*—Alvin S. Blum

(57) ABSTRACT

Apparatus for grooming and body care has a handle at a first, an elongate shaft, and a connector at a second end for removably attaching a selection of grooming and body care devices. The shaft is bendable in one mode of operation to enable the user to configure the apparatus for reaching certain parts of the body. In a second mode of operation, the shaft is rigid and remains in the position to which it was bent in the first mode. The apparatus can then be used without having it bend while in use. The selection and use may all be done with one hand. The grooming and body care devices may include sponges, brushes, combs, and shoehorns.

17 Claims, 2 Drawing Sheets

BENDABLE SHAFT BODY TOILETRY APPARATUS

BACKGROUND OF THE INVENTION

This invention relates to brushes, sponges, and other toiletry devices, and more particularly to such devices with a bendable shaft.

It is difficult for individuals to brush or scrub some body parts such as the back. For people with certain disabilities, the difficulty is often compounded. U.S. Pat. No. 6,546,588 issued Apr. 15, 2003 to Black is exemplary of inventions that provide a bendable shaft so that the body part is more easily reached. They have to compromise between making them easily bendable and yet sufficiently non-bendable so that they don't bend in use.

SUMMARY OF THE INVENTION

It is accordingly an object of the invention to provide a device with an elongate shaft, a free end with means for attaching a brush, comb, sponge, shoehorn, or other body care accessory, and a handle at the other end. The apparatus of the invention has a shaft with two operating modes. In a first mode, the shaft, or one or more portions thereof, is readily bendable to a desired shape. In a second mode of operation, the shaft is held rigidly in whatever shape it has been bent to. It is another object of the invention that either of the two modes of operation be selectable by a user with minimal effort. It is another object of the invention that the two modes of selection be operable by one hand so that a disabled person may find the apparatus useful without assistance. It is yet another object of the invention that a variety of personal care devices be easily interchanges at the free end of the shaft to convert it to different uses.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figures 1, 5, 6, 7:
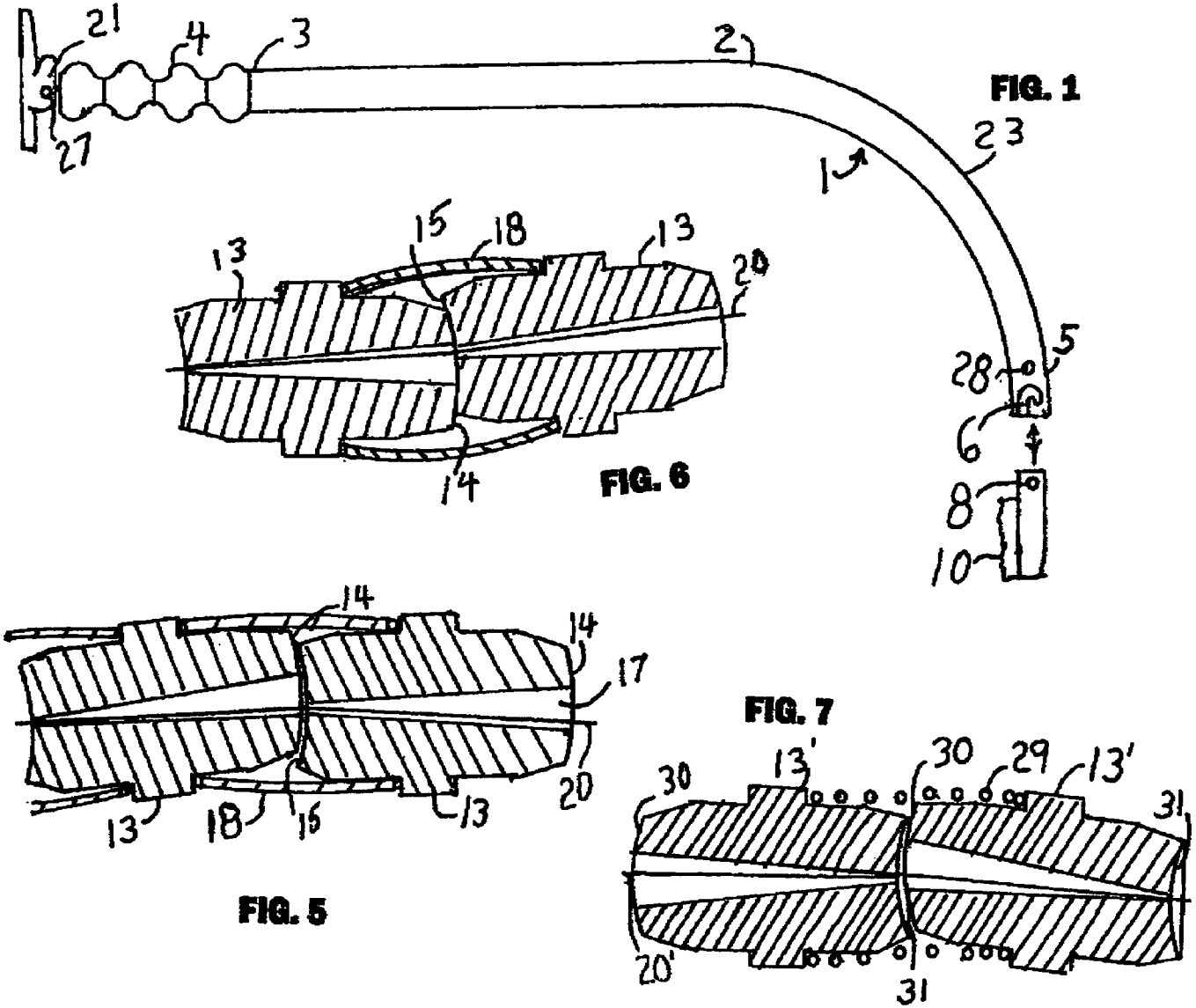
FIG. 1 is a side elevation view of the apparatus of the invention in second, or bendable mode.
FIG. 5 is a detail sectional view of several of the segments of the shaft in the second mode.
FIG. 6 is a detail sectional view of several of the segments in the first mode.
FIG. 7 is a detail sectional view of several of the segments of an alternative embodiment of the invention.
Figure 2:
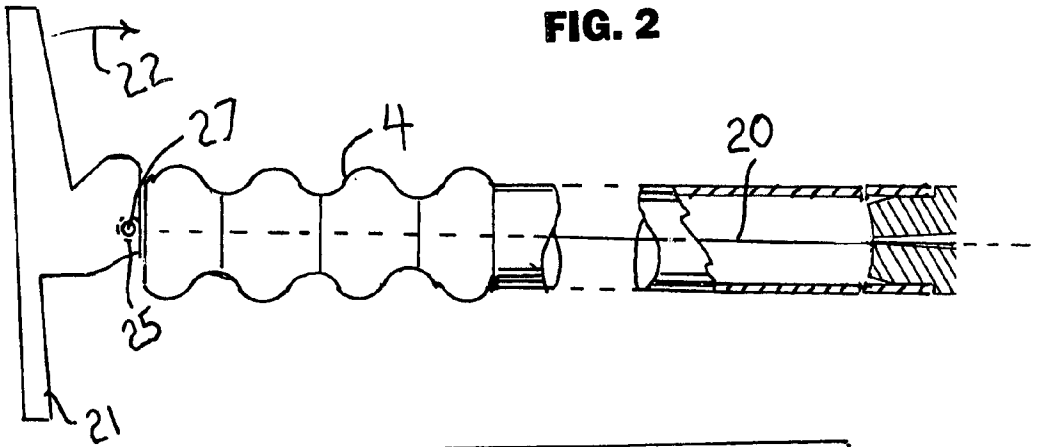
FIG. 2 is a detail view, partially broken away, of the handle end of the apparatus in the second mode.
Figure 3:
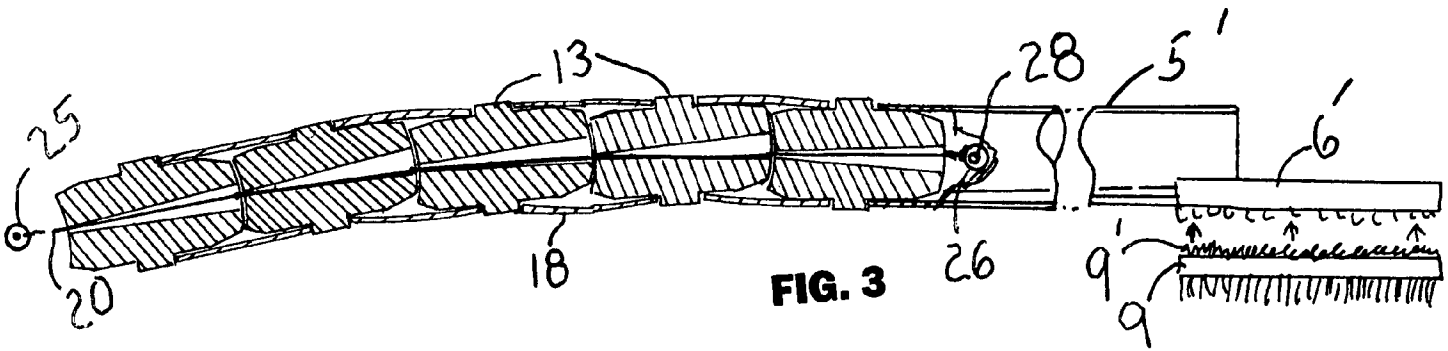
FIG. 3 is a detail view, partially broken away, of the connector end of the apparatus.

Referring now to the drawing FIGS. 1–6, the personal care apparatus 1 of the invention has an elongate shaft 2 with a first end 3 having a comfortable hand grip, or handle 4. A bayonet type connector 6 is provided at a second end 5. This bayonet type connector is well known in the vehicle arts. A sponge 10 having a complementary bayonet connecting means 8, is removably connectable to the bayonet connector. As shown in FIG. 3, alternatively, the connector 6' may be a hook portion of a hook and loop connector. A brush 9 having a loop element 9' is removably attachable to the free end 5'. Alternatively, other personal care and toiletry devices, such as, but not limited to, combs, shoehorns, and the like (not shown) may be provided with connecting means of the type shown in FIG. 1, for attachment to the second end 5.

Figure 4:
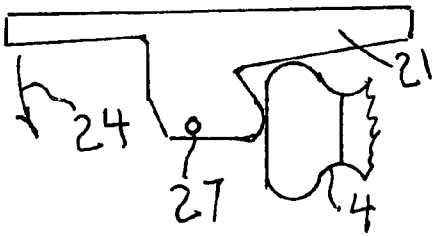
FIG. 4 is a side elevation view of the handle end in the first, or rigid mode.

A person with a disability may be unable to comfortably reach certain parts of the body. The elongate shaft 2 is provided with at least a portion 23 that is operable in two modes. In a rigid first mode, the sponge 10 is held rigidly on the free end so that it may be used effectively without bending of the shaft. In a flexible, or bendable, second mode the shaft is easily bent into the shape desired for effective use. A selection means 21 in condition for selecting the first mode is shown in FIG. 4. The selection means in condition for selecting the second, or flexible, mode is shown in FIGS. 1 and 2. The end of selection means 21 can be pushed in the direction shown by arrow 24 to move to the second or flexible mode. The end of selection means 21 can be pushed in the direction shown by arrow 22 to move to the first or rigid mode. Operation of the selection means 21 may be performed by a user having only one useful hand, such as many stroke patients. While holding the handle 4, either end of the selection means 21 may be forced against a solid surface to convert from one mode to the other.

A cord element 20 has a first end loop 25 rotatable about a pin 27 on the selection means 21. The cord 20 extends through axial passages in the handle portion, a plurality of segments 13 in the bendable portion 23, and the second end 5, where a second end loop 26 is anchored by a pin 28. Resilient bias means 18, such as rubbery tubing, interposed between segments 13 holds the segments apart from each other sufficiently so that their convex terminal surfaces 14 are not touching the adjacent concave terminal surfaces 15. The segments may be bent relative to one another to the extent permitted by the axial passages 17. The concave and convex terminal surfaces are sections of cylinders of a common radius. When cord 20 is pulled taut by operation of the selection means 21, the segments are pulled together, compressing the rubbery tubing, and forcing the surfaces 14, 15 against one another. Because they have common radii, they meet all along their adjacent surfaces. This provides great resistance against movement, causing the bendable portion 23 to become rigid. Being sections of a cylinder, bending is substantially allowable only in one plane.

Referring now to FIG. 7, another embodiment of the invention is shown in which the segments 13' are provides with concave end surfaces 31 and convex end surfaces 30 that are sections of a sphere of common radius. This enables the bendable portion to bend through more than a single plane. Compression springs 29 hold the segments apart.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Personal care apparatus comprising:

a) an elongate shaft;

b) a handle affixed to a first end of the shaft;

c) a connector affixed to a second end of the shaft;

d) at least one personal care device having connecting means for cooperating with the connector for removably attaching to the second end of the shaft;

e) a portion of the shaft intermediate the first and second ends constructed for operating in two modes, a first rigid mode, and a second flexible mode, the second mode enabling the portion to be bent to any one of a plurality of desired shapes, and the shaft portion in the first mode being fixed in the desired shape; and f) selection means at one of said ends for selecting between the first and second modes of operation, said selection means fixing the shaft portion in the desired shape when in the first rigid mode.

2. The apparatus according to claim 1 in which said selection means is operable with one hand.

3. The apparatus according to claim 2 in which the personal care device is from the group comprising brushes, combs, sponges, and shoehorns.

4. The apparatus according to claim 3 in which said connector is a bayonet connector.

5. The apparatus according to claim 3 in which said connector is a hook and loop connector.

6. The apparatus according to claim 1 in which the personal care device is from the group comprising brushes, combs, sponges, and shoehorns.

7. The apparatus according to claim 1 in which said connector is a bayonet connector.

8. The apparatus according to claim 1 in which said connector is a hook and loop connector.

9. The apparatus according to claim 1 in which said portion of the shaft comprises:

A) a plurality of segments;

B) each segment having i) an axial passage;

ii) a first terminus having convex curvature of a particular radius; and iii) a second terminus having a concave curvature of said particular radius;

C) resilient bias means interposed between segments to enable adjacent segments to move relative to one another;

D) an elongate cord element passing through the axial passages of the segments and connected to said selection means; and E) said selection means in said first mode of operation pulling the cord element taut to overcome the resilient bias means and pulling adjacent segments together such that the adjacent segments cannot move relative to one another to thereby make the shaft rigid.

10. The apparatus according to claim 9 in which the convex and concave curvatures are sections of a sphere.

11. The apparatus according to claim 9 in which the convex and concave curvatures are sections of a cylinder.

12. Personal care apparatus comprising:

a) an elongate shaft;

b) a handle affixed to a first end of the shaft;

c) a connector affixed to a second end of the shaft;

d) at least one personal care device having connecting means for cooperating with the connector for removably attaching to the second end of the shaft;

e) a portion of the shaft intermediate the first and second ends constructed for operating in two modes, a first rigid mode, and a second flexible mode f) selection means operable by one hand at one of said ends for selecting between the first and second modes of operation;

g) said portion of the shaft comprising a plurality of segments, each segment having;

i) an axial passage;

ii) a first terminus having convex curvature of a particular radius;

iii) a second terminus having concave curvature of said particular radius iv) resilient bias means interposed between segments to enable adjacent segments to move relative to one another in a second, flexible mode of operation;

v) an elongate cord element passing through the axial passages of the segments and connected to said selection means; and vi) said selection means in said first mode of operation pulling the cord elements taut to overcome the resilient bias means and pulling adjacent segments together such that the adjacent segments cannot move relative to one another to thereby make the shaft rigid.

13. The apparatus according to claim 12 in which the personal care device is from the group comprising brushes, combs, sponges, and shoehorns.

14. The apparatus according to claim 12 in which said connector is a bayonet connector.

15. The apparatus according to claim 12 in which said connector is a hook and loop connector.

16. The apparatus according to claim 12 in which the convex and concave curvatures are sections of a sphere.

17. The apparatus according to claim 12 in which the convex and concave curvatures are sections of a cylinder.

* * * * *